US006550435B1

(12) United States Patent
Zubeck

(10) Patent No.: US 6,550,435 B1
(45) **Date of Patent: *Apr. 22, 2003**

(54) VARIABLE VALVE TIMING ADJUSTABLE FINGER FOLLOWER ASSEMBLY

(75) Inventor: Michael Wayne Zubeck, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/683,554

(22) Filed: Jan. 17, 2002

(51) Int. Cl.[7] ..... F01L 1/34

(52) U.S. Cl. ..... 123/90.16; 123/90.25; 123/90.27; 123/90.39; 123/90.44; 123/90.52; 74/559; 74/569; 251/234

(58) Field of Search ..... 123/90.16, 90.25, 123/90.39, 90.44, 90.27, 90.43, 90.45, 90.52; 74/469, 559, 519; 251/279, 231, 234

(56) References Cited

U.S. PATENT DOCUMENTS

| | | | | |
|---|---|---|---|---|
| 4,151,817 A | | 5/1979 | Mueller | |
| 4,986,227 A | | 1/1991 | Dewey, III | |
| 5,080,054 A | | 1/1992 | Nakamura | |
| 5,251,586 A | | 10/1993 | Koga et al. | |
| 5,445,116 A | * | 8/1995 | Hara | 123/90.16 |
| 5,544,626 A | | 8/1996 | Diggs et al. | |
| 5,577,469 A | | 11/1996 | Muller et al. | |
| 5,655,488 A | | 8/1997 | Hampton et al. | |
| 5,899,180 A | * | 5/1999 | Fischer | 123/90.16 |
| 6,058,895 A | | 5/2000 | Hermsen | |
| 6,357,405 B1 | * | 3/2002 | Tsuji et al. | 123/90.16 |

FOREIGN PATENT DOCUMENTS

JP 54-114633 6/1979

OTHER PUBLICATIONS

Michael Wayne Zubeck, Variable Valve Timing Adjustable Roller Rocker Arm Assembly, U.S. patent application Ser. No. 09/682,276, Oct. 18, 2001.*

SAE Publication, "Variable Valve Actuation TOPTEC®: The State of the Art", Sep. 11–12, 2000, Ypsilanti Marriott at Eagle Crest, Ypsilanti, MI, 8 pp.

* cited by examiner

*Primary Examiner*—Thomas Denion
*Assistant Examiner*—Ching Chang

(57) ABSTRACT

A valve timing system for an internal combustion engine having a roller finger follower assembly including a lash adjustment mechanism. The roller finger follower assembly includes a base arm and a roller carriage that may be assembled to each other in a range of positions. The roller carriage supports a camshaft contact roller that may be moved by an adjustment mechanism to cause the camshaft contact roller to be contacted by the lobe of a camshaft in a range of angular relationships. The roller finger follower assembly includes a lash pin having a central section that is contoured to provide a secondary lash adjustment.

17 Claims, 4 Drawing Sheets

VARIABLE VALVE TIMING ADJUSTABLE FINGER FOLLOWER ASSEMBLY

BACKGROUND OF INVENTION

1. Field of the Invention

The present invention relates to a valve lifter finger follower for an internal combustion engine.

2. Background Art

Valves for internal combustion engines are generally opened and closed to allow for the intake and exhaust of gases in cylinders of the engine. Valves are operated by various valve lifter mechanisms including rocker arms and roller finger follower assemblies. Roller finger follower assemblies are well suited to overhead cam engines and also V-type engines. Timing valve opening and closing is important to maximize fuel efficiency, assure complete combustion, and maximize engine output. Adjusting valve timing can lead to improvements in fuel economy, engine emissions, torque and idle quality.

Many different approaches have been proposed for providing adjustable valve timing. Some prior art approaches include independent lifter control for each cylinder by means of electrical solenoids or by changing the pivot point for a rocker arm. Various other approaches have also been proposed.

There is a need for a system and apparatus for providing adjustable valve timing wherein the valve timing may be adjusted in a synchronized manner to minimize variation of timing from cylinder to cylinder. There is also a need for a simple and effective valve timing adjustment mechanism that may be used with intake or exhaust valves. There is also a need for a valve timing adjustment mechanism that is amenable to dual overhead cam and single overhead cam applications.

The above problems and objectives are addressed by the present invention as summarized below.

SUMMARY OF INVENTION

According to one of the aspects of the present invention, a valve timing system for an internal combustion engine is provided wherein a finger follower arm is attached to a camshaft contact roller in an adjustable manner that permits the roller to be located within a range of positions along the length of the finger follower arm. The roller is supported on the finger follower arm to contact a rotating cam on a camshaft. A linkage is provided for adjusting the position of the camshaft contact roller and thereby change the valve timing of the internal combustion engine.

According to another aspect of the invention, a roller finger follower assembly for an internal combustion engine is provided for an internal combustion engine having a camshaft. A lobe of the camshaft is rotated in accordance with the operating cycle of the internal combustion engine and contacts the roller finger follower assembly to open and close its associated valve. The roller finger follower assembly includes a base arm that is pivotally secured to a pivot connection and has a finger that engages the valve. A roller carriage supports a roller that is adjustably secured to the base arm with the roller being disposed between the pivot connection and the point at which the finger contacts the valve. The roller is positioned to contact the cam lobe as it is rotated by the camshaft. An adjustment link is provided for shifting the roller carriage relative to the base arm to cause the roller to contact the lobe of the camshaft within a range of angular positions relative to the camshaft.

According to another aspect of the invention, a finger follower assembly is provided for an internal combustion engine having at least one valve that is opened and closed in a timed manner to port combustion gases for the combustion chamber of the internal combustion engine. The internal combustion engine has at least one camshaft having at least one cam lobe that is rotated by the camshaft in accordance with the operating cycle of the internal combustion engine. The cam lobe contacts the roller finger follower assembly periodically to open and close the valve. The roller finger follower assembly includes a lash pin having a cam portion defining a contoured surface. A first linkage connector and a second linkage connector are provided on opposite ends of the lash pin. An arm is secured to the lash pin at a first end. The arm has a valve engaging finger that engages the valve at a second end of the arm opposite the lash pin. A roller is mounted on the arm between the lash pin and the finger and is positioned to be periodically contacted by the lobe on the camshaft that causes the valve to open and close periodically. First and second linkages are operatively connected to the roller to adjust the position of the roller on the arm. A lash adjuster is attached to the engine and is positioned to engage the lash pin. The lash adjuster is secured to the engine and is adjustable to change the point at which the contoured surface of the lash pin contacts the lash adjuster. Rotation of the lash pin causes the linkages to move the roller and also changes the point at which the lash adjuster contacts the contoured surface to thereby provide a secondary lash adjustment.

According to another aspect of the invention, the finger follower arm comprises a base arm and a roller carriage to which the camshaft contact roller is rotatably secured. The roller carriage is shiftably attached to the base follower arm that may be provided in a form of a track and track follower.

According to another aspect of the invention, the linkage may further comprise an adjustment link and an adjustment cam. The adjustment link is secured on a first end to the adjustment cam and on a second end is secured to the camshaft contact roller. A camshaft contact roller is secured to the finger follower arm and is engaged by a second end of the adjustment link to move the roller carriage relative to the finger follower arm.

The linkage may also include a lash pin that engages the finger follower arm wherein the lash pin is rotatable relative to the finger follower arm. The lash pin may be rotated to rotate the adjustment cam relative to the finger follower arm to cause the adjustment link to move the cam shaft contact roller.

According to another aspect of the invention, the camshaft contact roller is moveably mounted on the finger follower arm to cause the lift of the valve to occur at different timing positions relative to the rotating cam.

According to another aspect of the invention, the lash pin may include a contoured section that contacts a lash adjuster attached to the engine thereby permitting simultaneous adjustment of valve timing, valve lift and lash control. The lash adjuster may also include a friction cap that is interposed between the lash pin and lash adjuster to minimize wear of the lash pin and lash adjuster.

These and other advantages and aspects of the present invention will be apparent to one of ordinary skill in the art in view of the attached drawings and following detailed description of the embodiments of the invention below.

DETAILED DESCRIPTION

Figure 1:
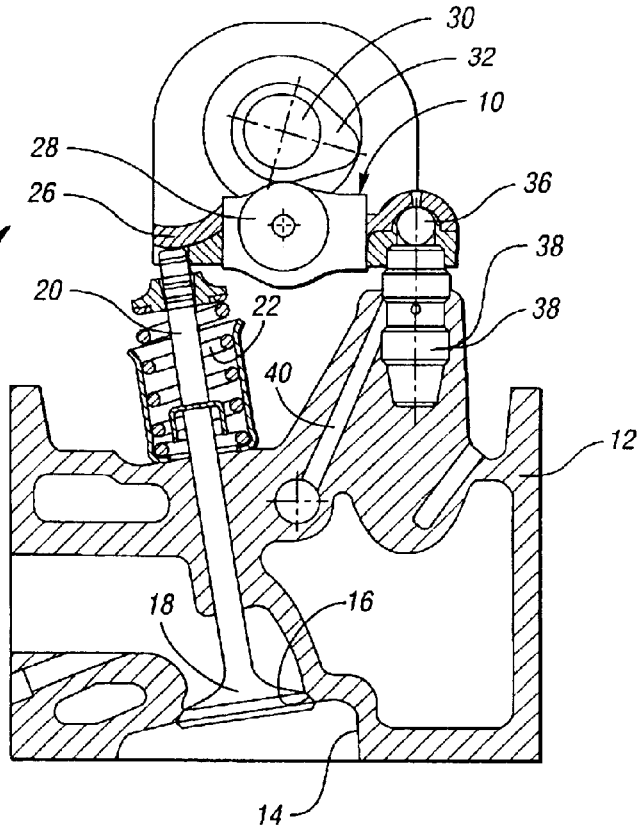
FIG. 1 is fragmentary cross-sectional view of part of an internal combustion engine having a valve and roller finger follower assembly made in accordance with the present invention.

Referring now to FIG. 1, a roller finger follower assembly 10 is shown as part of an internal combustion engine 12. The internal combustion engine 12 has combustion chambers 14 having a plurality of valve ports 16 that are opened and closed by means of a valve 18. The valves 18 may be either intake or exhaust valves that may be adjusted independently. The exhaust valves may be adjusted for emission control and the intake valves may be adjusted for improved performance. The valve 18 has a valve stem 20 and a valve spring 22 that biases the valve 18 to close the valve port 16. The valve stem 20 is contacted by a finger 26 of the roller finger follower assembly 10. A camshaft contact roller 28 is part of the roller finger follower assembly 10. A camshaft 30 including a plurality of lobes 32 is mounted adjacent the roller finger follower assembly 10 on the internal combustion engine 12 so that as the camshaft 30 rotates the lobe 32 it periodically contacts the camshaft contact roller 28. The camshaft contact roller 28 is moved downwardly as depicted in FIG. 1 when the lobe 32 contacts the camshaft contact roller 28. This downward movement is transferred to the finger 26 that contacts the valve stem 20 and shifts it so that the valve 18 opens the valve port 16.

A lash pin 36 is secured to the roller finger follower assembly 10 at the opposite end of the assembly from the finger 26. The lash pin 36 also includes a hydraulically actuated lash adjuster 38. The lash adjuster 38 may be adjusted by providing hydraulic fluid through a manifold 40 formed in the internal combustion engine 12.

Figure 2:
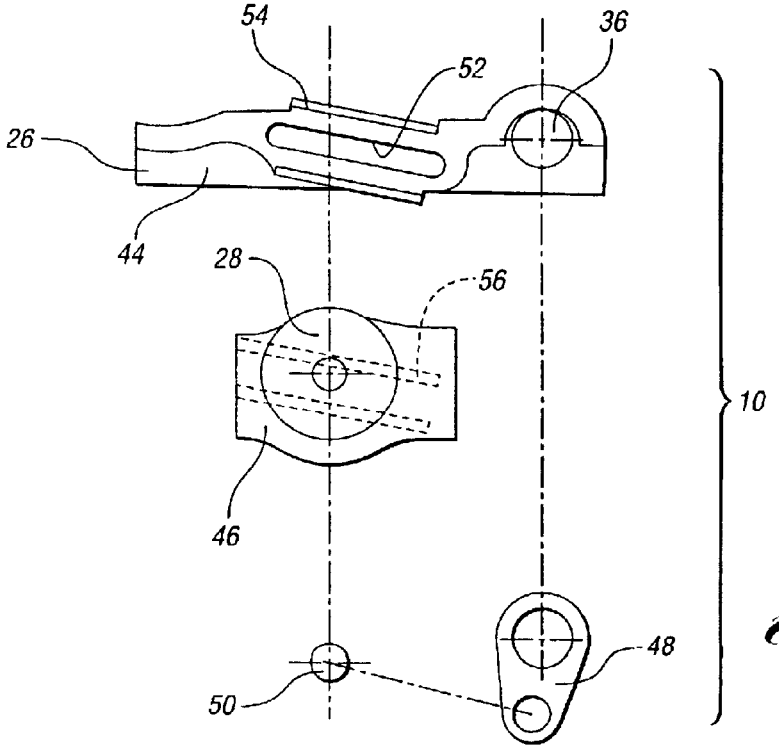
FIG. 2 is a exploded elevational view of a roller finger follower assembly made according to the present invention.

Referring now to FIG. 2, some of the components of the roller finger follower assembly 10 are shown in greater detail. A base arm 44 including a finger 26 and lash pin 36 is illustrated. A roller carriage 46 that supports the camshaft contact roller 28 and adjustment cam 48 is shown detached from the lash pin 36. A shaft 50 is provided to connect the camshaft contact roller 28 to the roller carriage 46 and is also inserted in a slot 52. The base arm 44 includes a first track 54 while the roller carriage 46 includes a second track 56. The first track 54 is a set of elongated ribs and the second track 56 is a set of slots. First and second tracks 54, 56 are provided to guide movement of the roller carriage 46 on the base arm 44 while the shaft 50 remains within the slot 52. Shaft 50 is positionable at any point along the slot 52.

Figure 3:
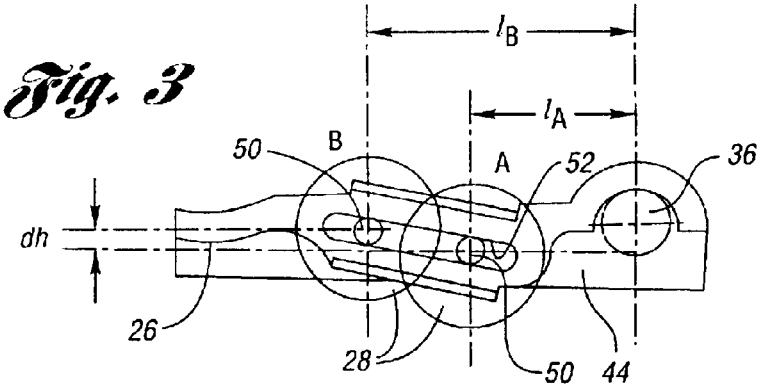
FIG. 3 is a diagrammatic view of a roller finger follower assembly showing the roller in two different positions.

Referring now to FIG. 3, the base arm 44 is shown with the camshaft contact roller 28 in two different positions denominated positions A and B. The camshaft contact roller 28 when in position A is a distance $I_A$ from the center line of the lash pin 36. When the camshaft contact roller 28 is in position B, the center of the shaft 50 is a distance $I_B$ from the center line of the lash pin 36. The change in lift that may be achieved by moving the roller from position A to position B is designated "dh" and is illustrated by arrows to the left of the finger 26 in FIG. 3.

Figure 4:
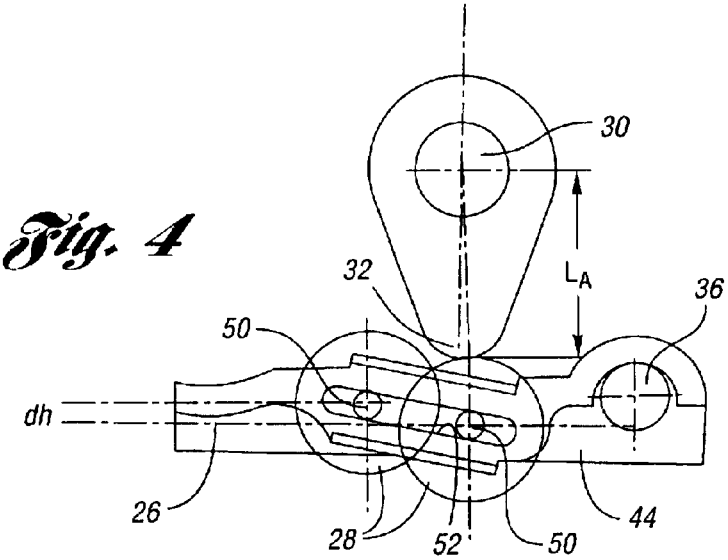
FIG. 4 is a diagrammatic view of a roller finger follower assembly with the lobe of the camshaft engaging the roller in position A.

Referring now to FIG. 4, roller finger follower assembly 10 Is shown in conjunction with a camshaft 30 and lobe 32 with the roller 28 in position A corresponding to a position that would be preferred when the engine is running at high load with low torque output. The distance between the center line of the camshaft 30 and the contact point on the roller 28 is designated $I_A$ and the center line of the roller 28 and the shaft 50 is shown by the lower line.

Figure 5:
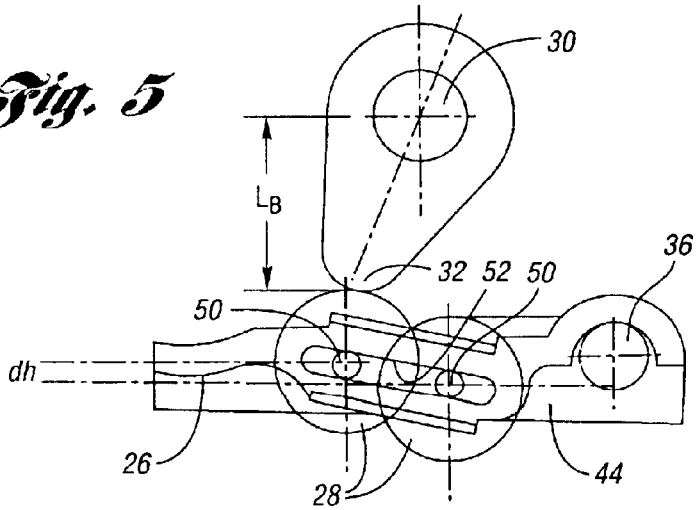
FIG. 5 is a diagrammatic view of a roller finger follower assembly and camshaft with the camshaft engaging the roller in position B.

Referring now to FIG. 5, the roller finger follower assembly 10, camshaft 30, and lobe 32 are shown with the roller 28 in position B that corresponds to a low load operational mode with high torque output. When the roller 28 is in position B, the center line of the camshaft 30 is a distance $L_B$ from the contact point with the roller 28. In this position opening of the valve 18 is retarded in comparison to the arrangement shown in FIG. 4 and the degree of valve 18 lift is reduced by "dh" that corresponds to the distance between the two phantom lines shown at the left side of FIG. 4.

Figure 6:
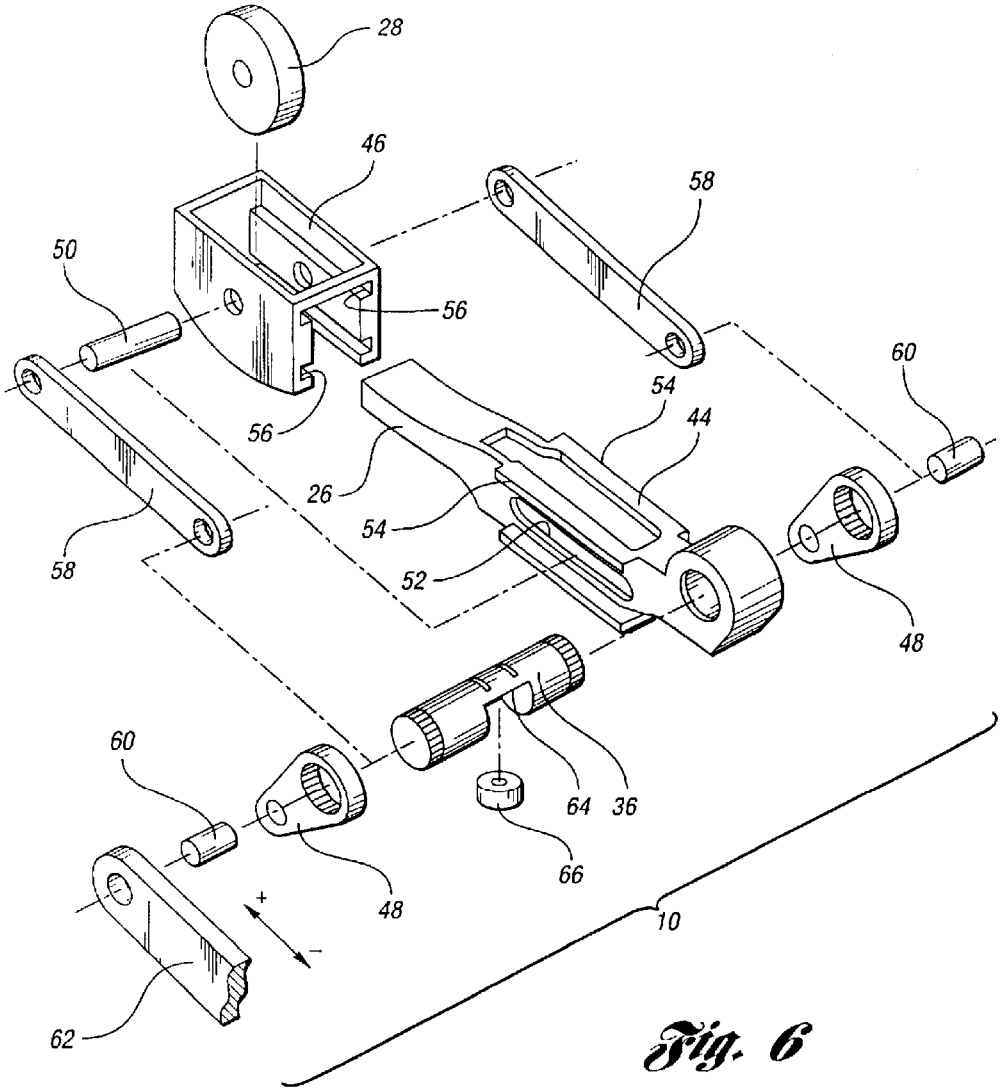
FIG. 6 is an exploded perspective view of a roller finger follower assembly made according to the present invention.

Referring now to FIG. 6, the roller finger follower assembly 10 is shown in the exploded perspective. The base arm 44 and the roller carriage 46 are secured together and moveable relative to each other by means of the cooperating first and second tracks 54, 56. The location of the roller carriage 46 on the base arm 44 is adjusted by means of the adjustment arm 62 that is connected by pin 60 to the adjustment cam 48. An adjustment cam 48 is provided on both sides of the base arm 44. The two adjustment cams 48 are press fit or otherwise secured on opposite sides of the lash pin 36. When the adjustment arm 62 is moved, the adjustment cam 48 moves arcuately causing the lash pin 36 to rotate and also causing the adjustment links 58 to move the roller carriage 46 via the shaft 50. The camshaft contact roller 28 is mounted on the shaft 50. The shaft 50 is moveable within slot 52 that limits the relative movement of the roller carriage 46 relative to the base arm 44.

The lash pin includes a central section 64 that is contoured to provide a secondary auxiliary lash adjustment mechanism that is coordinated with the position of the adjustment cam 48 and roller carriage 46. The secondary lash adjustment is used to maintain proper lash for NVH and arm ejection. The central section 64 may be characterized as having an elliptical cross-section, a cross-section generated by intersecting circular surfaces, or any other cross-section that provides different radius contact points as the lash pin is rotated. A friction cap 66 is received on the central section 64 between the lash pin 36 and the lash adjuster 38.

Figure 7A:
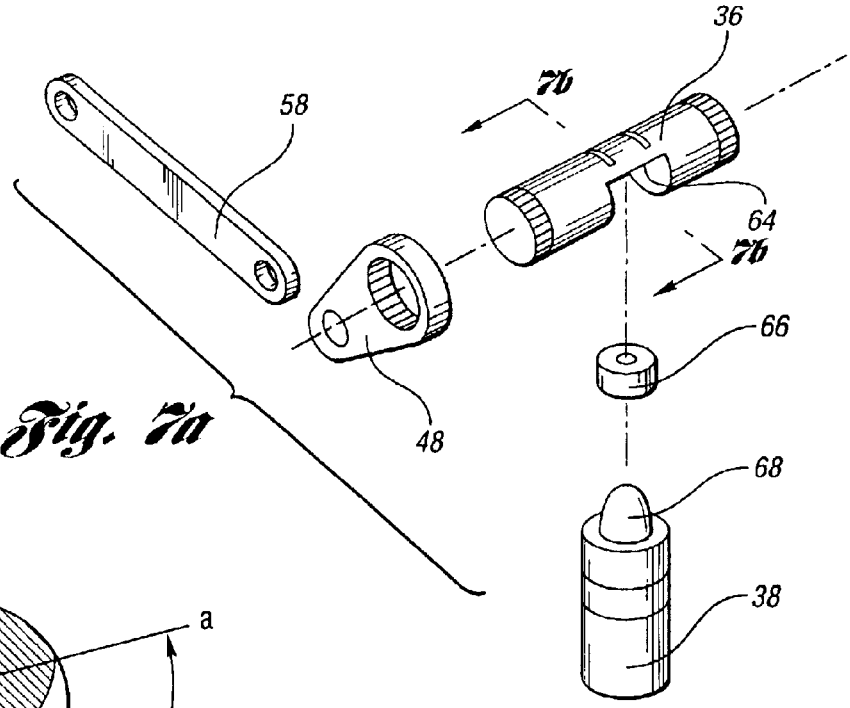
FIG. 7*a* is an exploded perspective view of a lash pin and lash adjuster made in accordance with the present invention.
Figure 7B:
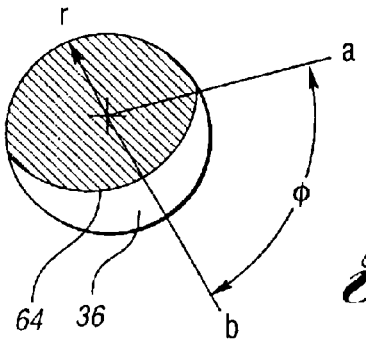
FIG. 7*b* is a cross-sectional view taken along the line 7*b*—7*b* in FIG. 7*a;*

Referring now to FIGS. 7*a* and *b,* the lash pin 36 and lash adjuster 38 are shown in greater detail. FIG. 7*b* illustrates an exemplary cross-section of the central section 64 of the lash pin 36. The angle θ indicated by the arcuate line extending from a to b illustrates the angular positions of the lash pin between positions A and B shown in FIGS. 4 and 5 above. As shown in FIG. 7*a,* the distance from the center of the lash pin 36 to the point of contact with the friction cap 66 at position "A" is approximately equal to the radius of the lash pin. At position "B", the thickness of the lash pin is reduced thereby providing an automatic adjustment that compensates for movement of the roller carriage 46 on the base arm 44.

Figure 8A:
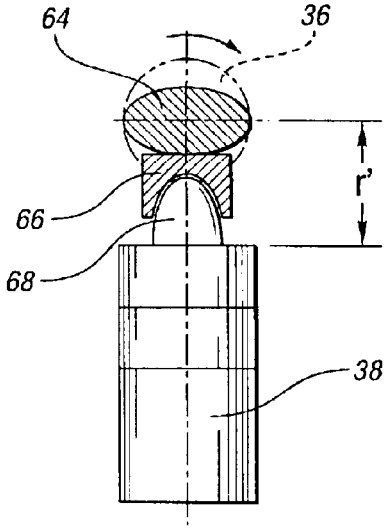
FIG. 8*a* is a diagrammatic partial cross-sectional view showing the lash adjuster and lash pin in a position corresponding to the position of the cam and roller shown in FIG. 4.
Figure 8B:
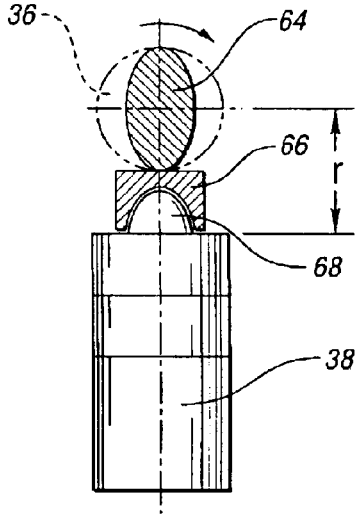
FIG. 8*b* is a diagrammatic partial cross-sectional view showing the lash adjuster and lash pin in a position corresponding to the position of the camshaft and roller shown in FIG. 5.

Referring now to FIGS. 8*a* and *b,* the lash pin 36 and lash adjuster 38 are shown in greater detail. The central section 64 as shown in FIGS. 8*a* and *b* is an elliptical section. This alternative would be acceptable but would be more difficult to manufacture than the central section 64 illustrated in FIG. 7*b*. The lash adjuster 38 includes a nose 68 on which the friction cap 66 is received. The lash adjuster 38 may be adjusted by supply or withdrawing hydraulic fluid through the hydraulic fluid supply manifold 40 for the primary lash adjustment. Lash adjustment is provided to eliminate noise and chatter associated with the roller finger follower assemblies 10. As shown in FIG. 8*a,* the central section 64 is rotated to its minimum height position that allows the nose 68 to be extended from the lash adjuster 38. As shown in FIG. 8*b,* the central section 64 is rotated to a vertical orientation wherein the radius of the central section 64 is maximized relative to the contact point with the friction cap 66. This causes the friction cap 66 to force the nose 68 toward the lash adjuster 38.

In operation, the adjustment arm 62 is moved to rotate the adjustment cams 48. The adjustment cams 48 shift the adjustment length 58 to move the cam shaft contact roller 28 that is carried by the roller carriage 46 on the base arm 44. Movement of the cam shaft contact roller 28 adjusts the timing and lift of the valve 18. The adjustment cams 48 are attached to the lash pin 36 that controls the distance from the lash adjuster 38 to the base arm 44. In accordance with one embodiment of the invention, a one-step timing, lift, and lash adjustment mechanism is provided.

The roller finger follower arm is adjustable to vary valve timing and lift. Force applied through the adjustment arm 62 is used to shift the roller carriage 46 on the base arm 44. Valve timing may be adjusted as illustrated above between positions A and B. Valve timing and lift may be further modified depending upon the base arm track 54 and configuration of the slot 52. The adjustment cam 48 on the lash pin 36 controls the distance of the roller 28 from the lash pin 36. The contoured portion 64 of the lash pin 36 provides a secondary lash adjustment. The secondary lash adjustment is accomplished in concert with adjustments in the position of the roller 28.

While the best mode for carrying out the invention has been described in detail, those familiar with the art to which this invention relates will recognize various alternative designs and embodiments for practicing the invention as defined by the following claims.

What is claimed is:

1. A valve timing system for internal combustion engine having at least one valve having a valve stem and at least one rotating cam, the valve timing system comprising:

a finger follower arm having a first end extending to the valve stem;

a camshaft contact roller attached to the finger follower arm and being adjustable within a range of positions along the length of the finger follower arm, the camshaft contact roller being supported on the finger follower arm to contact the rotating cam; and a linkage connected to the camshaft contact roller and a second end of the finger follower arm that adjusts the position of the camshaft contact roller to change the valve timing of the internal combustion engine.

2. The valve timing system of claim 1 wherein the finger follower arm further comprises a base follower arm and a roller carriage, wherein the camshaft contact roller is rotatably secured to the roller carriage, and the roller carriage is slidably attached to the base follower arm.

3. The valve timing system of claim 2 wherein the base follower arm and the roller carriage have a first track and a second track, respectively.

4. The valve timing system of claim 1 wherein the linkage further comprises an adjustment link and an adjustment cam, the adjustment link being secured to the adjustment cam on a first end and being secured to the cam shaft contact roller on a second end, wherein the camshaft contact roller is secured to the finger follower arm and is engaged by the second end of the adjustment link for movement relative to the finger follower arm.

5. The valve timing system of claim 4 wherein the linkage further comprises a lash pin that engages the finger follower arm, the lash pin being rotatable relative to the finger follower arm, wherein the lash pin may be rotated to rotate the adjustment cam relative to the finger follower arm that causes the adjustment link to move the camshaft contact roller.

6. The valve timing system of claim 1 wherein the camshaft contact roller is secured to the finger follower arm by a pin that extends through a slot formed in the finger follower arm.

7. The valve timing system of claim 6 wherein the slot extends generally lengthwise of the finger follower arm.

8. The valve timing system of claim 1 wherein the cam shaft contact roller is moveable on the finger follower arm to cause the lift of the valve to occur at different timing positions relative to the rotating cam.

9. A roller finger follower assembly for an internal combustion engine having at least one valve that is opened and closed in a timed manner to port combustion gases for a combustion chamber of the internal combustion engine, the internal combustion engine having at least one cam shaft having at least one cam lobe that is rotated by the cam shaft in accordance with the operating cycle of the internal combustion engine, the cam lobe contacts the roller finger follower assembly periodically to open and close the valve, the roller finger follower assembly comprising:

a base arm that is pivotally secured to a pivot connection, the base arm having a valve engaging finger that engages the valve at a location spaced from the pivot connection;

a roller carriage supporting a roller that is adjustably secured to the base arm so that the roller is disposed between the pivot connection and the point at which the finger contacts the valve, the roller being positioned to contact the cam lobe as it is rotated by the cam shaft; and an adjustment link for shifting the roller carriage relative to the base arm to cause the roller to contact the lobe of the cam shaft within a range of angular positions relative to the cam shaft.

10. The roller finger follower assembly of claim 9 wherein the roller carriage is slidably attached to the base arm.

11. The roller finger follower assembly of claim 9 wherein the adjustment link comprises an elongated link and an adjustment cam, the elongated link having first and second ends with the first end being connected to the roller by a shaft that supports the roller on the base arm and the second end being connected to the adjustment cam.

12. The roller finger follower cam assembly of claim 11 wherein the pivot connection is a rotatable lash pin and the adjustment cam is attached to the lash pin, and wherein the lash pin is mounted on the base arm at the opposite end of the base arm from the cam engaging finger, the lash pin being rotatable relative to the base arm, wherein the lash pin may be rotated to rotate the adjustment cam to cause the adjustment link to move the roller carriage on the base arm.

13. The roller finger follower cam assembly of claim 12 wherein the lash pin includes a contoured section that contacts a lash adjuster attached to the engine that permits simultaneous adjustment of valve timing, valve lift and lash control.

14. The roller finger follower cam assembly of claim 13 wherein the lash adjuster includes a friction cap that is interposed between the lash pin and the lash adjuster that minimizes wear of the lash adjuster.

15. The roller finger follower cam assembly of claim 9 wherein the roller is secured to a shaft that extends through a slot formed in the base arm.

16. The roller finger follower cam assembly of claim 13 wherein the slot extends generally lengthwise of the base arm.

17. A finger follower cam assembly for an internal combustion engine having at least one valve that is opened and closed in a timed manner to port combustion gases for a combustion chamber of the internal combustion engine, the internal combustion engine having at least one cam shaft having at least one cam lobe that is rotated by the cam shaft in accordance with the operating cycle of the internal combustion engine, the cam lobe contacts the finger follower assembly periodically to open and close the valve, the finger follower assembly comprising:

a lash pin, the lash pin having a cam portion defining a contoured surface, a first linkage connector and second linkage connector being provided on opposite ends of the lash pin, first and second linkage connectors being secured to a first linkage and a second linkage, respectively;

an arm to which the lash pin is secured at a first end, the arm having a valve engaging finger that engages the valve at a second end of the arm opposite the lash pin, a roller mounted on the arm between the lash pin and the finger, the roller being positioned to be periodically contacted by the lobe on the cam shaft that causes the valve to open and close periodically, first and second linkages being operatively connected to the roller to adjust the position of the roller on the arm; and a lash adjuster attached to the engine and being disposed to engage the lash pin, the lash adjuster being secured to the engine and adjustable to change the point at which the elliptical surface of the lash pin contacts the lash adjuster, wherein rotation of the lash pin causes the linkages to move the roller and also changes the point at which the lash adjuster contacts the contoured surface to thereby provide a secondary lash adjustment.

* * * * *